US007818826B2

(12) United States Patent
Schmidt et al.

(10) Patent No.: US 7,818,826 B2
(45) Date of Patent: Oct. 26, 2010

(54) LAMINAR FLOW JET FOR POOLS AND SPAS

(75) Inventors: Darrell Schmidt, Simi Valley, CA (US); Francisco Hinojosa, Jr., Santa Paula, CA (US); Jose Cervantes, Oxnard, CA (US)

(73) Assignee: B & S Plastics, Inc., Oxnard, CA (US)

( * ) Notice: Subject to any disclaimer, the term of this patent is extended or adjusted under 35 U.S.C. 154(b) by 1231 days.

(21) Appl. No.: 11/404,149

(22) Filed: Apr. 13, 2006
(Under 37 CFR 1.47)

(65) Prior Publication Data

US 2006/0253972 A1 Nov. 16, 2006

Related U.S. Application Data

(60) Provisional application No. 60/671,277, filed on Apr. 13, 2005.

(51) Int. Cl.
*A61H 33/04* (2006.01)

(52) U.S. Cl. ..... 4/541.6; 4/541.1

(58) Field of Classification Search ..... 4/541.6
See application file for complete search history.

(56) References Cited

U.S. PATENT DOCUMENTS

| | | | | |
|---|---|---|---|---|
| 3,851,825 | A * | 12/1974 | Parkison et al. | 239/590.3 |
| 4,795,092 | A | 1/1989 | Fuller | 239/12 |
| 5,160,086 | A * | 11/1992 | Kuykendal et al. | 239/18 |
| 6,510,277 | B1 | 1/2003 | Dongo | 385/147 |
| 6,848,637 | B2 | 2/2005 | Holtsnider | 239/587.1 |
| 2003/0010836 | A1 * | 1/2003 | Pham | 239/17 |
| 2005/0155144 | A1 * | 7/2005 | McDonald et al. | 4/507 |

* cited by examiner

*Primary Examiner*—Gregory L Huson
*Assistant Examiner*—Karen Younkins
(74) *Attorney, Agent, or Firm*—Koppel, Patrick, Heybl & Dawson

(57) ABSTRACT

A laminar flow jet is disclosed that provides a non-turbulent smooth stream of water. The jet is structured to remove turbulence from the moving water. As the water flows through the jet, a screen component and a nozzle component cooperate to slow the water flow and provide a uniform flow direction. The jet is also structured so that the laminar stream may be lighted from within the jet. The body of the jet is designed to receive an elongated and transparent probe carrying a lighting apparatus such as a fiber optic cable. The laminar flow jet is designed to be mounted to a structure such as a spa, pool or tub wall.

8 Claims, 8 Drawing Sheets

LAMINAR FLOW JET FOR POOLS AND SPAS

This application claims the benefit of U.S. Provisional Patent Application No. 60/671,277 to Schmidt et al., which was filed on Apr. 13, 2005.

BACKGROUND OF THE INVENTION

1. Field of the Invention

This invention relates to flow jets for pools and spas and more particularly to flow jets that produce a laminar stream of water.

2. Description of Related Art

Various flow jets have been developed for use in spas, hot tubs, pools and bath tubs.

Known flow jets purposely output water that is turbulent in order to produce desirable under water effects. The use of the same flow jets at positions above the water level of a pool or spa to provide, for example, a water fountain effect when the spa is not in use, produces above water effects that are generally unappealing to the visual and auditory senses. For this reason it may be desirable to eliminate turbulence in the water flow and produce a smooth, laminar stream of water which gives the appearance of a solid glass rod.

Furthermore, it is often desirable to include additional aesthetic components to flow jets used in spas, pools and hot tubs such as lighting equipment. Reservoirs of water such as pools and spas are commonly constructed with one or more underwater light sources for illuminating the water within the reservoir. The light sources are visually appealing and the illumination of the water allows for safe use of the pool or spa at night. Lights may also be shown to have additional therapeutic qualities (e.g. calming and soothing effects).

Fiber optic lighting systems have been developed such as the one that is the subject of U.S. Pat. No. 6,510,277 to Dongo. The system includes a remote light source and numerous optical fibers directed toward individual spa components. An elongated and transparent probe is mounted within the component and extends from the rear of the component toward the front. The probe is open at the rear of the jet and is hollow through most of its length to receive and house an optical fiber. The light emitting from the end of the fiber passes through the end of the probe and out of the component.

SUMMARY OF THE INVENTION

The present invention provides a new laminar flow jet that produces a non-turbulent smooth stream of water. The new jet is structured to remove turbulence from the water flowing through it to provide lighting internally. The new jet can be mounted to a pool, spa or tub.

The new laminar flow jet includes a body having a water inlet, a screen, and a nozzle, wherein the screen and the nozzle cooperate to output a non-turbulent laminar stream of water.

In one embodiment, a hydrotherapy system includes a shell defining a reservoir for water; a water pump system; a plurality of underwater jets connected to the water pump system by a plurality of conduits; a drain system re-circulating the water back to the water pump; and at least one laminar flow jet disposed above the water level, outputting a non-turbulent laminar stream of water.

In another embodiment, a lighted laminar fountain system includes a reservoir structure for holding water; at least one laminar flow jet disposed above the water level on the structure, producing a non-turbulent stream of water; a mounting system for attaching the laminar flow jet to the reservoir structure; and a plurality of lights disposed inside the laminar flow jet, the light illuminating the non-turbulent stream of water.

These and further features and advantages of the invention will be apparent to those skilled in the art from the following detailed description, taken together with the accompanying drawings, in which:

DETAILED DESCRIPTION OF THE PREFERRED EMBODIMENTS

Figure 1:
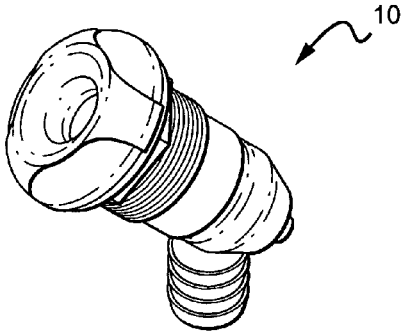
FIG. 1 is a perspective view of a flow jet according to the present invention.
Figure 2:
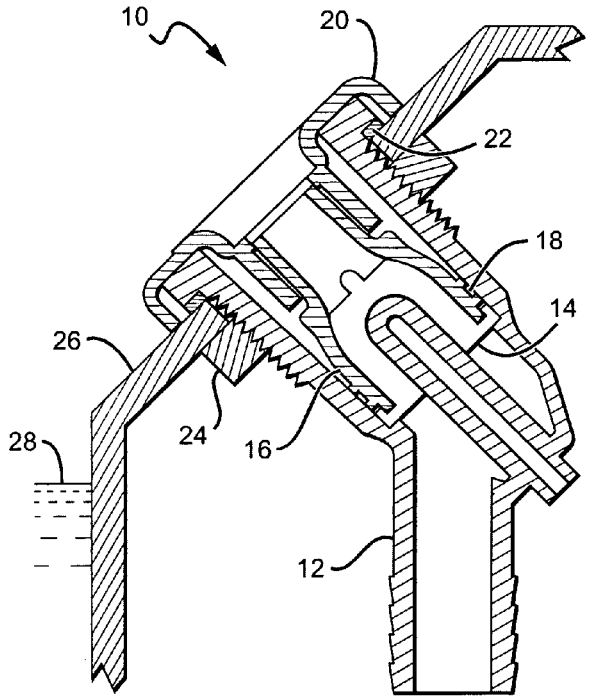
FIG. 2 is a sectional view of the jet shown in FIG. 1.
Figure 3:
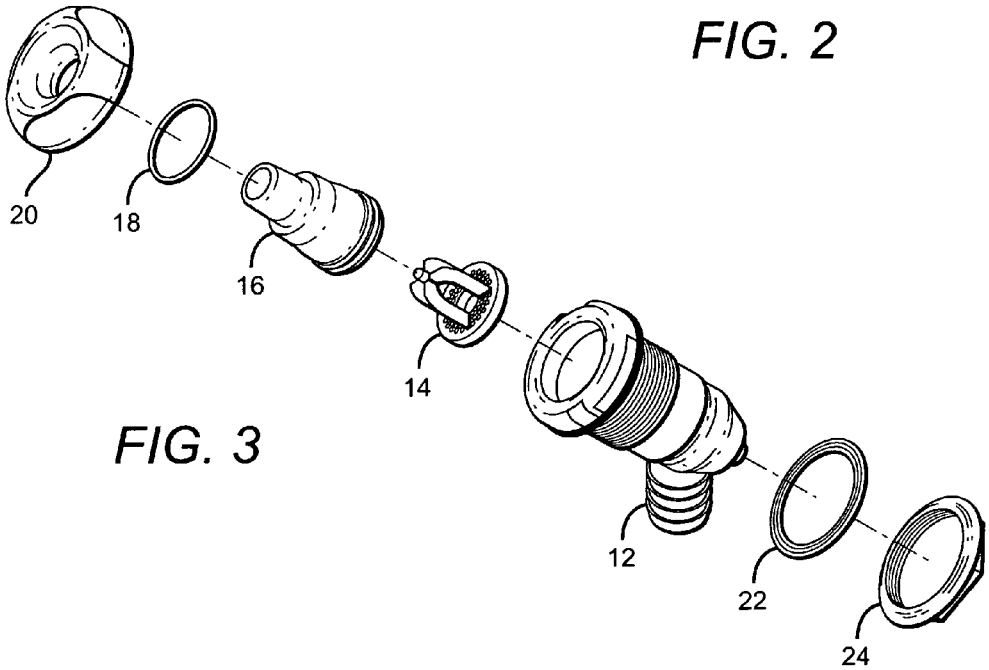
FIG. 3 is an exploded view of the jet shown in FIG. 1.
Figure 4:
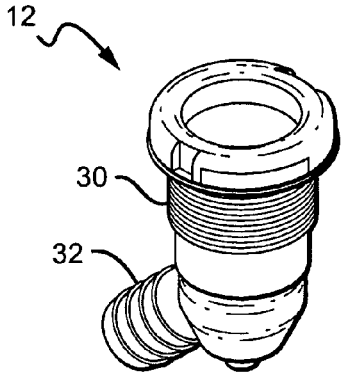
FIG. 4 is a perspective view of a jet body included in the jet in FIG. 1.
Figure 5:
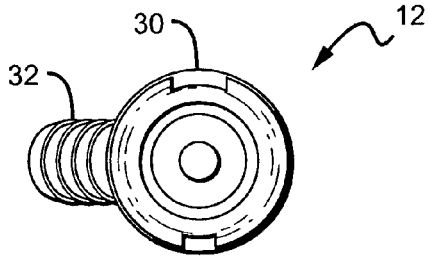
FIG. 5 is a top view of the body shown in FIG. 4.
Figure 7:
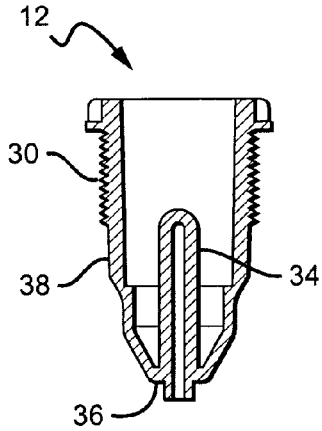
FIG. 7 is a sectional view of the body shown in FIG. 12 taken along line 7-7 of FIG. 6*a;*
Figure 6A:
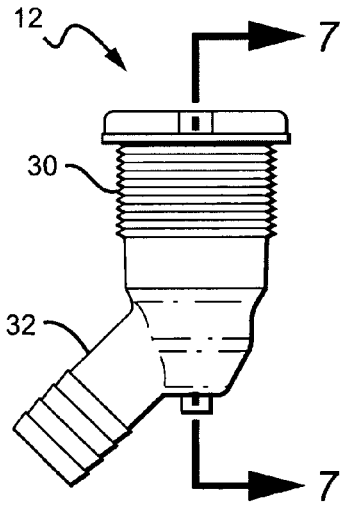
FIGS. 6*a*-6*c* are various side views of the body of FIG. 4.
Figure 6B:
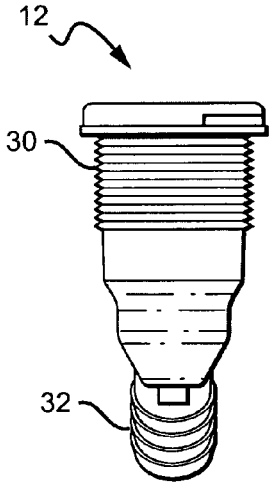
Figure 6C:
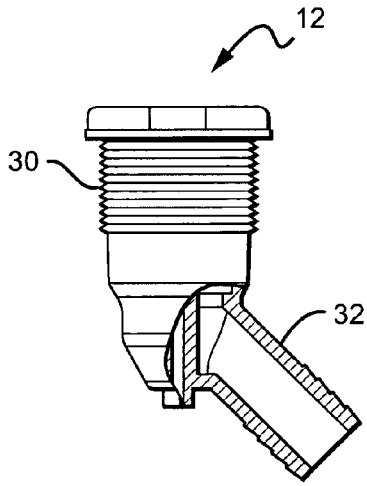
Figure 8:
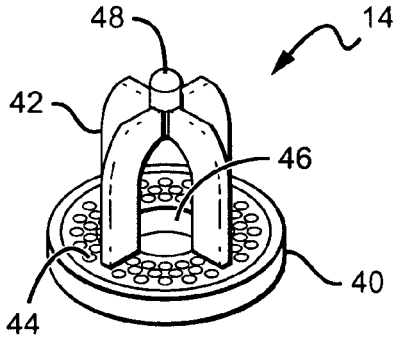
FIG. 8 is a perspective view of a screen included in the jet in FIG. 1.
Figure 9:
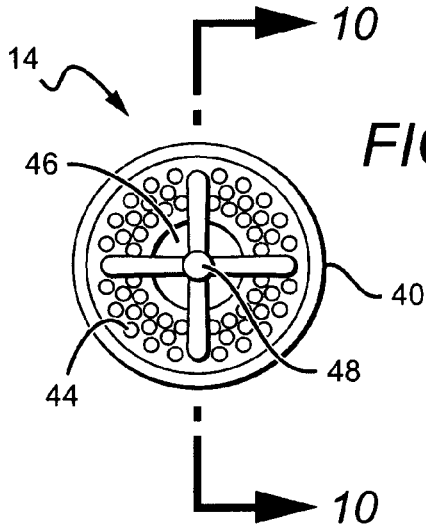
FIG. 9 is a top view of the screen shown in FIG. 8.
Figure 10:
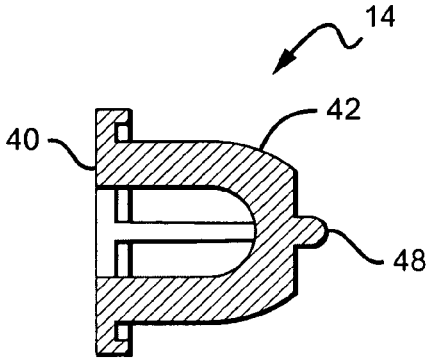
FIG. 10 is a sectional view of the screen shown in FIG. 8 taken along lines 10-10 in FIG. 9.
Figure 11:
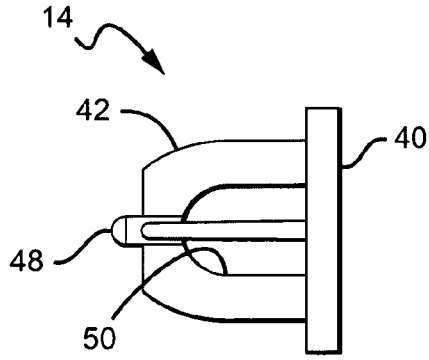
FIG. 11 is a side view of the screen in FIG. 8.
Figure 12:
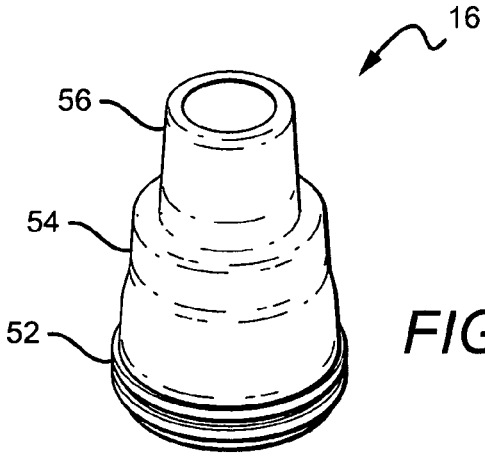
FIG. 12 is a perspective view of a nozzle included in the jet in FIG. 1.
Figure 13:
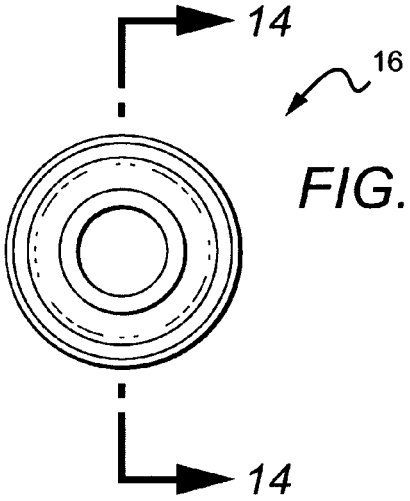
FIG. 13 is a top view of the nozzle shown in FIG. 12.
Figure 14:
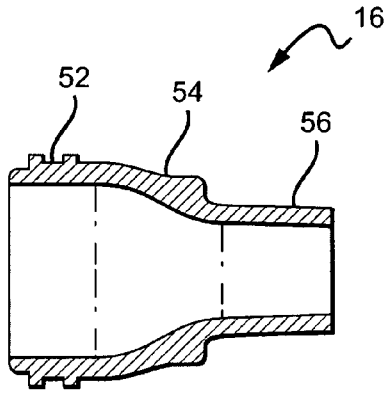
FIG. 14 is a sectional view of the nozzle shown in FIG. 4 taken along lines 14-14 in FIG. 13.
Figure 15:
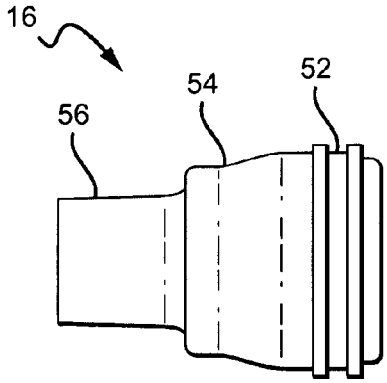
FIG. 15 is a side view of the nozzle in FIG. 12.
Figure 16A:
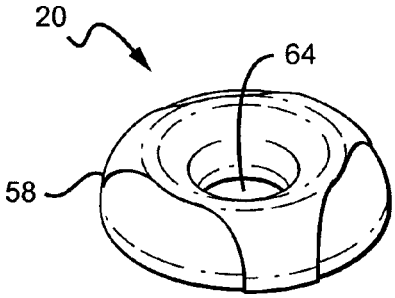
FIGS. 16*a* and 16*b* are perspective views of a cap included in the jet in FIG. 1.
Figure 16B:
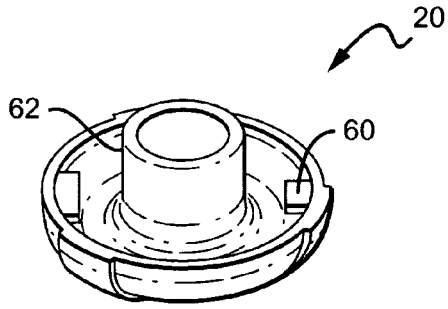
Figure 17:
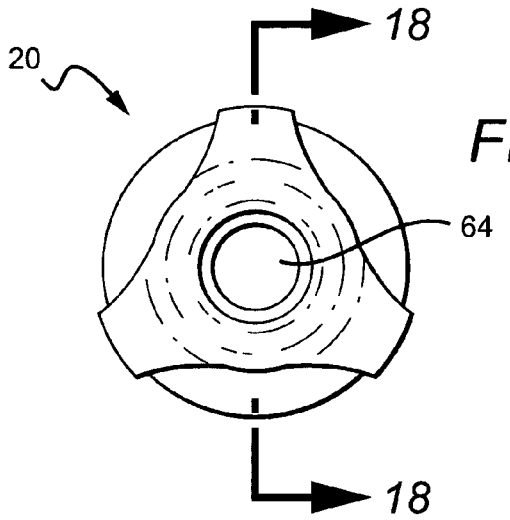
FIG. 17 is a top view of the cap as shown in FIG. 16*a;*
Figure 18:
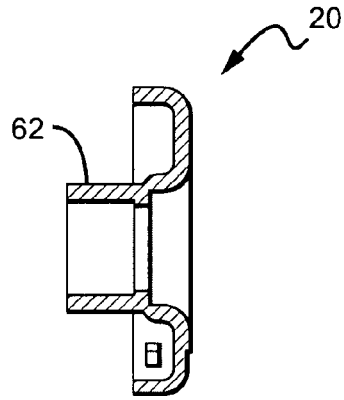
FIG. 18 is a sectional view of the cap in FIG. 16*a* taken along line 18-18 in FIG. 17.
Figure 19:
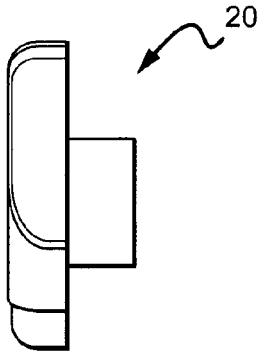
FIG. 19 is a side view of the cap of FIGS. 16*a* and 16*b;*
Figure 20:
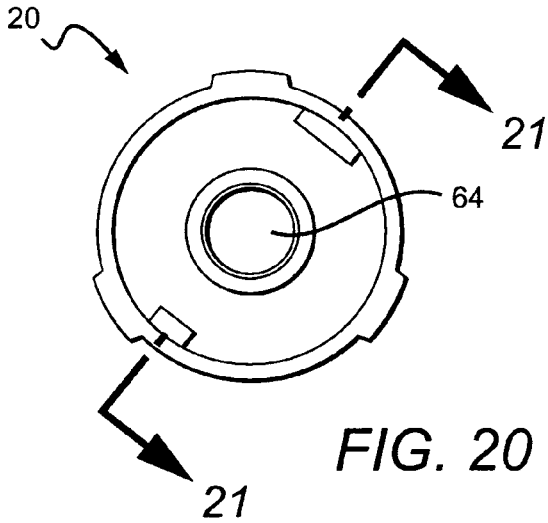
FIG. 20 is a top view of the cap as shown in FIG. 16*b*.
Figure 21:
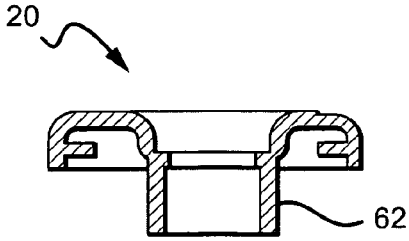
FIG. 21 is a sectional view of the cap in FIG. 16*b* taken along line 21-21 of FIG. 20.

Referring now to the drawings and particularly to FIGS. 1-3, there is shown a laminar flow jet configured in accordance with the invention. The jet 10 includes a body 12, a screen 14, a nozzle 16, an o-ring 18, a cap 20, a gasket 22 and a nut 24. As shown in FIG. 2, the flow jet 10 is secured to a shell 26 of a pool or spa using the nut 24, preferably at a position above the water level 28.

With reference to FIGS. 4-7, the body 12 includes a housing 30 and a water inlet tube 32. The housing 30 houses the screen 14, nozzle 16 and o-ring 18. The inlet tube 32 is adapted for connection to a water source. The housing 30 is formed to include a center tube 34 that extends from the bottom 36 of the housing to about the middle 38 of the housing. The center tube 34 is open at the bottom and is sized to receive a fiber optic probe (not shown).

With reference to FIGS. 8-11, the screen 14 includes a flat ring 40 and a number of dividers 42 projecting upward from a face of the ring. The ring 40 includes a number of apertures 44 arranged in a pattern, for example as shown here, concentric circles around a center opening 46. The center opening 46 is sized to fit around the center tube 34 of the body 12. The dividers 42 project upward and over and join at a hub 48 that is generally aligned with the axis of the opening 46. The inner profile 50 formed by inside walls of the dividers 42 is shaped to receive the center tube 34 of the body 12. The screen 14 is made of a material such as PVC, which as described below, may be in a preferred embodiment a semi-transparent or a transparent material.

With reference to FIGS. 12-15, the nozzle 16 includes a threaded region 52, a taper region 54 and a tip region 56. The threaded region 52 is configured to engage a threaded portion on the interior wall of the housing 30 of the body 12. The threaded region 52 and taper region 56 receive the screen 14 when the jet is assembled. The nozzle 16 is made of a material such as PVC which as described below, may be in a preferred embodiment at least semi-transparent (i.e. semi-transparent or transparent).

With reference to FIGS. **16*a*-21, the cap 20 includes an annular grip 58 having an opening 64. Positioned around the inside edge of the cap 20 are a number of projections 60 that engage the top of the housing 30 of the body 12. The cap 20 also includes a tube portion 62 having an inner diameter sized to receive the tip region 56 of the nozzle 16**.

Figure 22:
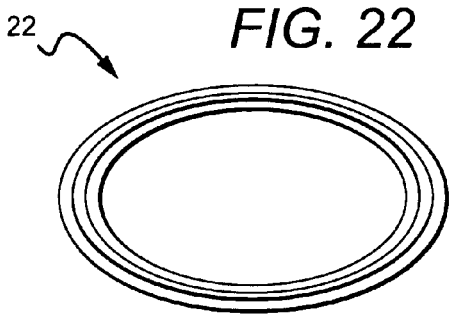
FIG. 22 is a perspective view of a gasket included in the jet in FIG. 1.
Figure 23:
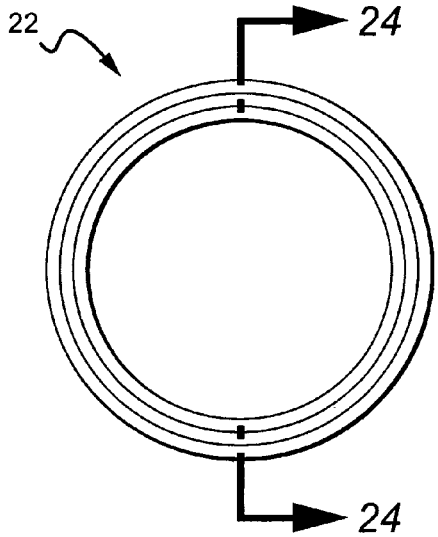
FIG. 23 is a top view of the gasket shown in FIG. 22.
Figure 24:
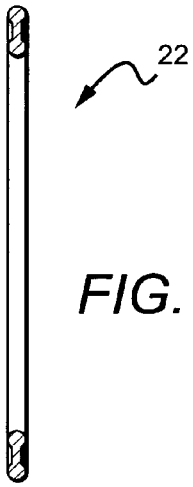
FIG. 24 is a sectional view of the gasket of FIG. 22 taken along line 24-24 of FIG. 23.

FIGS. 22-24 show a gasket 22. When the jet is mounted the gasket is sandwiched between the nut 24 and the cap 20.

Figure 25:
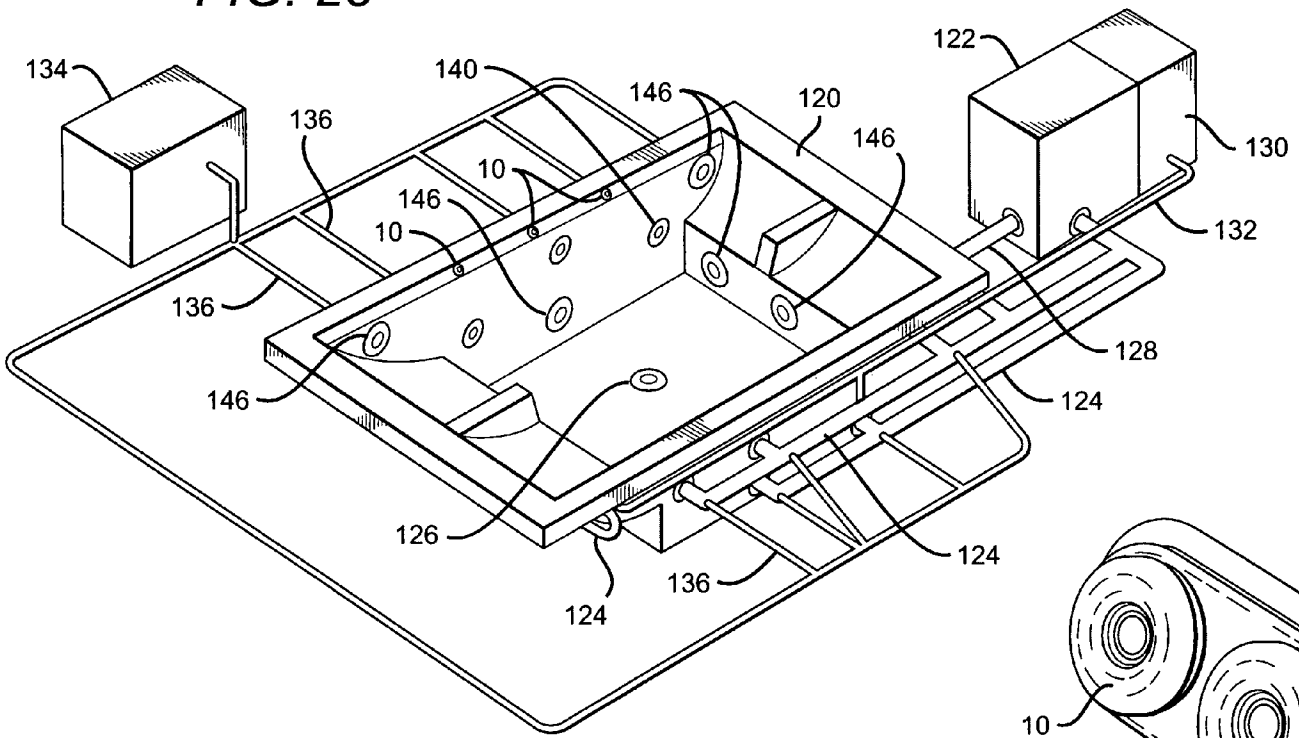
FIG. 25 is a perspective view of a spa system including the flow jets in FIG. 1.

As shown in FIG. 25, laminar jets 10 may be installed in a spa shell 120 with underwater jets such as stationary jets 140 and/or pulsating jets 146. In operation, the jets are connected to a water pump system 122 which circulates the water throughout the spa system through a series of water conduits 124. Water from the spa is provided to pump 122 through a drain 126 which is connected to a return water conduit 128, and in turn to pump 122. Water from the pump 122 is delivered back to spa 120 through conduits 124, and flows through and into the interior of shell 120, completing the loop. Additionally, an air system 130 can be included that provides air to the under water jets 140, 146, through an air conduit 132 to aerate the water flowing through those jets. The air system 130 can be pump driven to increase the pressure of the air entering the jet, or the system can be vacuum based with the venturi located within the jets drawing air into the jet water streams.

Figure 26:
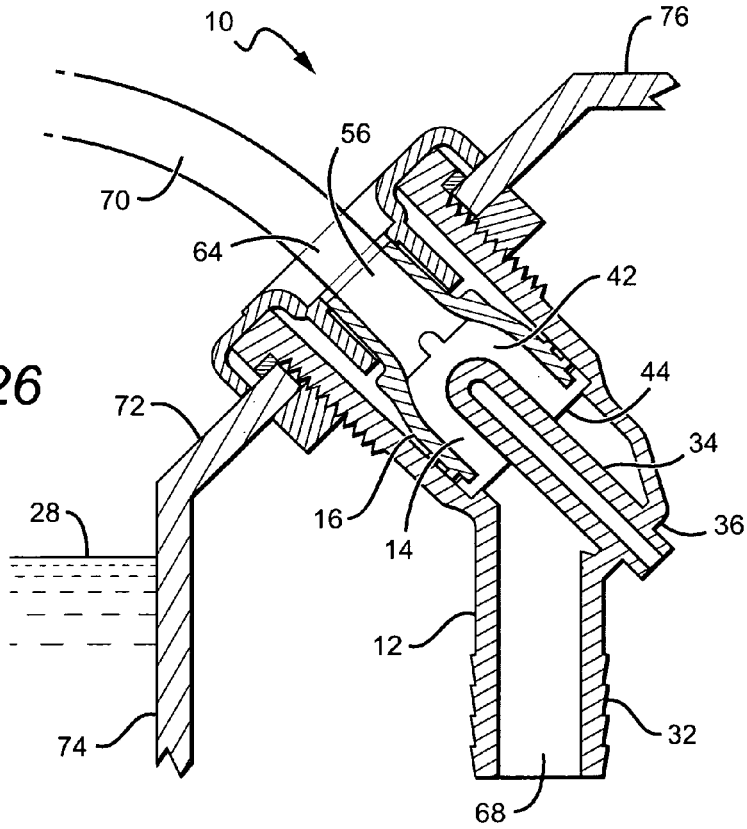
FIG. 26 is a sectional view of a portion of the spa system of FIG. 25 showing a flow jet mounted to a bevel portion of the spa shell.

With reference to FIG. 26, regarding the laminar flow jets 10, turbulent water is provided to the water inlet tube 32 of the body 12 from a water supply. The water 68 enters the bottom 36 of the housing around the center tube 34 and passes through the apertures 44 in the screen 14. The apertures 44 and dividers 42 slow down the water and cause the water 68 to flow in a straight path from the screen 14 toward the nozzle 16. The water then enters the tip 56 of the nozzle 16 and is then ejected at a point above the water level 28 through the cap opening 64 as a laminar stream 70 that eventually hits the water level 28 giving the appearance and sound of a water fountain.

Figure 27:
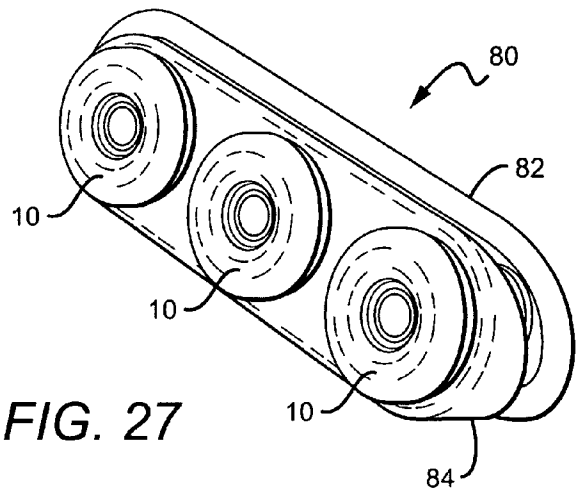
FIG. 27 is a perspective view of a flow jet system including a mounting system.
Figure 29:
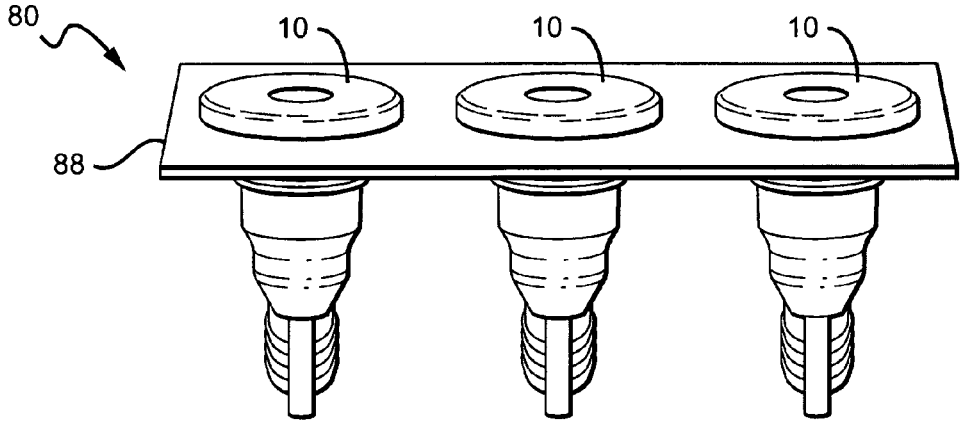
FIG. 29 is view of a flow jet system including an alternate configuration of a mounting system.
Figure 28:
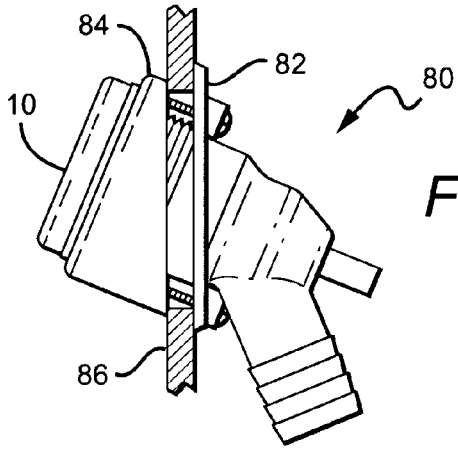
FIG. 28 is a side view of the flow jet system of FIG. 27 mounted to a vertical sidewall of a spa shell.

The jet 10 is particularly well-suited for addition to a pool or spa having a beveled transition region 72 between the vertical walls 74 and top horizontal portions 76 of the shell. With reference to FIGS. 27-29, in other embodiments, the flow jet 10 includes a mounting system 80, which in a rear-mounting configuration (FIGS. 27 and 28) includes a rear plate 82 and a front plate 84 and in a front-mounting configuration (FIG. 29) includes only a front-mounting plate 88. The mounting system 80 allows for installation of the flow jet to the vertical wall 86 of a pool or spa. In either configuration, the front plate 84 and the front-mounting plate 88 are shaped to point the flow jets 10 at an upward angle with respect to the water line.

Figure 30:
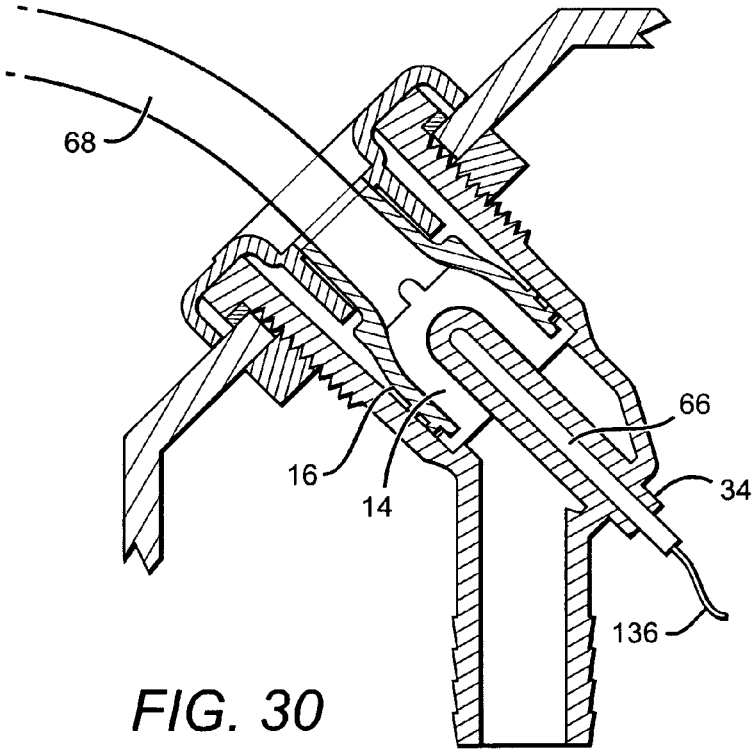
FIG. 30 is a sectional view of a flow jet including a fiber optic probe for illumination.

With reference to FIGS. 25 and 30, in another configuration, a light probe 66 is inserted in the center tube 34 of the body 12 and the stream of water output by the jet is illuminated. In this configuration, it has been noted that when either one or both of the screen 14 and the nozzle 16 is formed of a transparent or semi-transparent material, the illumination output of the jet is improved A remote fiber optic light source 134 (FIG. 25) provides light that is carried by optical fibers 136 to the jets 10, 140, 146, and to any other desired component such as the drain 126. The light source can have a single color, or it can include a color wheel that rotates to continuously change the color. The jets and the drain 126 each include a light probe 66, with one or more of the optical fibers 136 inserted into each of the probes. Light travels from the light source 134 through the optical fibers 136 and into the jets 10, 140, 146 and the drain 126. The light that emits from the ends of the optical fibers is refracted through the probes 66 to illuminate the water.

Although the present invention has been described in considerable detail with reference to certain preferred configurations, other versions are possible. The invention can be used in spas, pools, tubs and the like. Therefore, the spirit and scope of the appended claims should not be limited to the preferred versions described above.

We claim:

1. A hydrotherapy system, comprising:

a shell defining a reservoir for water;

a water pump system;

a plurality of underwater jets connected to said water pump system by a plurality of conduits;

a drain system re-circulating the water back to said water pump; and at least one laminar flow jet disposed above the water level, outputting a non-turbulent laminar stream of water, said laminar flow jet comprising a screen component, wherein said screen component comprises:

a base piece having a center opening and a plurality of apertures arranged in an aperture pattern around said center opening; and a plurality of dividers extending away from said base piece in a direction normal to said base piece, said dividers defining an inner profile capable of receiving a tube, with a light probe disposed in said tube.

2. The hydrotherapy system of claim 1, said laminar flow jet further comprising a nozzle, wherein said screen and said nozzle cooperate to remove turbulence from flowing water and produce said non-turbulent laminar stream of water.

3. The hydrotherapy system of claim 1, further comprising:

an air system providing air to said underwater jets through an air conduit.

4. The hydrotherapy system of claim 3, wherein the air system is driver by a pump.

5. The hydrotherapy system of claim 3, wherein the air system is driven by a vacuum.

6. The hydrotherapy system of claim 1, further comprising a fiber optic lighting system.

7. The hydrotherapy system of claim 6, wherein said fiber optic lighting system produces at least two different colors of light.

8. The hydrotherapy system of claim 6, said fiber optic lighting system further comprising:

a fiber optic light source remote to said shell; and a plurality of optical fibers carrying said light to said underwater jets and said laminar flow jets.

* * * * *